US006190121B1

(12) United States Patent
Hayward et al.

(10) Patent No.: US 6,190,121 B1
(45) Date of Patent: Feb. 20, 2001

(54) CENTRIFUGAL PUMP WITH SOLIDS CUTTING ACTION

(75) Inventors: John Hayward, North York; Carlos Cohen, Toronto, both of (CA)

(73) Assignee: Hayward Gordon Limited, Mississauga (CA)

( * ) Notice: Under 35 U.S.C. 154(b), the term of this patent shall be extended for 0 days.

(21) Appl. No.: 09/250,069

(22) Filed: Feb. 12, 1999

(51) Int. Cl.[7] ..... F01D 25/00
(52) U.S. Cl. ..... 415/121.1; 415/206
(58) Field of Search ..... 415/121.1, 121.2, 415/169.1, 206; 241/46.06, 46.08, 46.11, 185.6

(56) References Cited

U.S. PATENT DOCUMENTS

| | | | | |
|---|---|---|---|---|
| 368,416 | | 8/1887 | Mosher . | |
| 746,007 | | 12/1903 | Brüncker . | |
| 2,012,568 | | 8/1935 | Kiss . | |
| 2,201,947 | | 5/1940 | Valentine . | |
| 2,236,706 | | 4/1941 | Damonte . | |
| 2,646,974 | | 7/1953 | Read . | |
| 2,978,233 | | 4/1961 | Davey . | |
| 2,985,952 | | 5/1961 | Nutter et al. . | |
| 3,013,501 | | 12/1961 | Ygge . | |
| 3,128,051 | * | 4/1964 | Smith | 241/185.6 |
| 3,155,046 | | 11/1964 | Vaughan . | |
| 3,340,812 | | 9/1967 | Schlesiger . | |
| 3,375,983 | | 4/1968 | Von Eiff et al. . | |
| 3,447,475 | | 6/1969 | Blum . | |
| 3,746,467 | * | 7/1973 | Buse | 416/186 |
| 3,973,866 | | 8/1976 | Vaughan . | |
| 3,989,406 | | 11/1976 | Bliss . | |
| 4,143,993 | | 3/1979 | Blum . | |
| 4,349,322 | * | 9/1982 | Stahle | 417/370 |
| 4,472,109 | | 9/1984 | Blum . | |
| 4,767,277 | * | 8/1988 | Buse | 416/214 A |
| 4,778,336 | | 10/1988 | Husain . | |
| 4,842,479 | | 6/1989 | Dorsch . | |
| 5,076,757 | | 12/1991 | Dorsch . | |
| 5,242,124 | | 9/1993 | Latzel et al. . | |
| 5,256,032 | | 10/1993 | Dorsch . | |
| 5,302,082 | | 4/1994 | Gilbert . | |
| 5,456,580 | * | 10/1995 | Dorsch | 416/223 B |
| 5,460,482 | | 10/1995 | Dorsch . | |

FOREIGN PATENT DOCUMENTS

| | | | | |
|---|---|---|---|---|
| 880252 | | 6/1953 | (DE) . | |
| 256486 | | 8/1926 | (GB) . | |
| 433618 | | 8/1935 | (GB) . | |
| 54-108904 | * | 8/1979 | (JP) | 415/121.1 |
| 89-143645 | * | 11/1988 | (SU) | 415/121.1 |

OTHER PUBLICATIONS

Tsurumi Manufacturing Co. Ltd., Rugged, Powerful Tsurumi Pumps For Perfect Sewage & Waste Water Control, C Series.

Allis–Chalmers Manufacturing Co, "Type SSOR Pumps", Bulletin 1643–B, Apr. 1937, pp 3–7.

* cited by examiner

*Primary Examiner*—F. Daniel Lopez
*Assistant Examiner*—James M McAleenan
(74) *Attorney, Agent, or Firm*—Baker & Daniels

(57) ABSTRACT

A centrifugal pump has an impeller rotatable by means of a drive shaft. The impeller has a plurality of radially extending vanes connected to a hub and a partial back shroud with sharpened leading edges. The pump has a pump casing with a back plate adjacent to the back side of the impeller. Spiral grooves on the back plate interact with the sharpened edges on the back shroud to aid in protecting the area between the back plate and the impeller by cutting of solids and expulsion of solids through an output port. Preferably the leading edges on the back shroud are also serrated and beveled and the spiral grooves are outward threaded. A disintegrator is preferably mounted on the end of the drive shaft in the conical intake of the pump. Also, cutting bars on the front plate of the casing project into the pump intake and interact with front edges of the vanes to cut incoming solids in a liquid mixture.

19 Claims, 6 Drawing Sheets

CENTRIFUGAL PUMP WITH SOLIDS CUTTING ACTION

BACKGROUND OF THE INVENTION

The present invention relates to centrifugal pumps, and in particular, pumps of this type that have a chopping or cutting capability.

A variety of centrifugal pumps are known currently which are capable of pumping liquids and slurries containing solid matter such as small pieces of garbage or other disposed items. These pumps have the capability of chopping or cutting solid matter in the liquid mixture permitting the output from the pump to be disposed of more readily.

U.S. Pat. No. 3,155,046 issued Nov. 3, 1964 to James E. Vaughan describes a centrifugal pump for pumping a mixture of liquid and stringy solid material that includes a housing with a peripheral wall having a discharge aperture therein, a closed end, and an open end. The pump has an impeller secured on a shaft and the impeller has radially disposed impeller blades. Edges of these vanes adjacent to the pump inlet co-operate with sharpened edges of pump inlet apertures to cut solid material entering the pump.

One pump known in the prior art is the ABS "Piranha" Grinder pump. This pump incorporates sharpened spiral cutting grooves on the inside of an intake plate of the pump. Front edges on the impeller vanes of the pump rotate against the grooves to produce a cutting action. The edges of the vanes are flat in profile. This pump design is susceptible to binding problems from material being wedged between the impeller edges and the intake plate.

Another known pump is the Vaughan chopper pump disclosed in U.S. Pat. No. 5,256,032 issued Oct. 26, 1993. Features to chop and expel material from behind the impeller of the pump are incorporated into the design. The pump incorporates elongated curved vanes of the impeller operating in close cutting relationship with axially protruding ribs on a back plate of the casing. The vanes of the pump produce a cutting action as they pass over the ribs on the back plate.

Yet another known centrifugal pump is the screw centrifugal pump which utilizes spiral grooves in the rear face of the impeller of the pump and on the back plate of the casing of the pump. The rotating groove in the rear of the impeller operates against the stationary grooves in the casing backplate providing the function of discharging solids from the space between the backplate and impeller of the pump.

An object of the present invention is to provide a novel and durable centrifugal pump effective for pumping a mixture including solids suspended in a liquid.

A further object of the invention is to provide a centrifugal pump having an improved impeller with both radially extending vanes and a generally radial, partial back shroud with sharpened leading shroud edges that cooperate with grooves formed on a back plate of the pump casing. The sharpened shroud edges and the grooves interact to cut solids that have entered the pump through the intake port.

SUMMARY OF THE INVENTION

According to one aspect of the invention, a centrifugal pump capable of cutting solid matter in a liquid comprises a rotatable drive shaft defining an axis of rotation, an impeller mounted on this drive shaft, and a pump casing. The impeller has a set of radially extending vanes and a generally radial, partial back shroud that extends between the vanes and has substantial cutouts positioned between the vanes to make the back shroud a partial shroud. Sharpened with sharpened leading shroud edges are provided along sides of the cutouts. The vanes project generally forwardly from the shroud and towards an intake port of the pump. A casing includes a bowl encircling the impeller and forms the intake port adjacent to a front side of the impeller. The casing further includes a back plate adjacent to the back shroud, this back plate having spiral grooves facing the back shroud. The sharpened shroud edges and the spiral grooves interact to cut solids that have entered the pump through the intake port.

Preferably the vanes are curved and the leading shroud edges are beveled and serrated.

According to another aspect of the invention, a centrifugal pump suitable for pumping a liquid mixture containing solids includes a rotatable drive shaft defining an axis of rotation and an impeller mounted on this drive shaft for rotation therewith. The impeller has radially extending vanes and a generally radial, partial back shroud located at rear edges of the vanes. The shroud extends between the vanes and has substantial cutouts located between adjacent vanes to make the shroud a partial shroud. Leading shroud edges, are formed along sides of the cutouts which are sharpened. The pump also has a pump casing for forming a pump bowl that surrounds the impeller, an intake port adjacent to a front side of the impeller, and a pump outlet. The pump casing includes a back plate located next to the back shroud and having spiral shaped grooves extending circumferentially thereon and facing the back shroud. The shaft extends through this back plate. The sharpened shroud edges and the grooves interact to cut solids that have entered into the pump bowl.

In the preferred embodiment, the pump casing includes an intake plate that forms the intake port and at least a portion of the inner sidewall of this intake plate has spiral grooves which interact with sharpened front edges of the vanes to provide further cutting of solids entering the pump.

According to a further aspect of the invention, a centrifugal pump suitable for pumping a liquid mixture containing solids includes a rotatable drive shaft, an impeller mounted on this drive shaft and a pump casing for forming a pump bowl that surrounds the impeller. The impeller has at least several radially extending vanes and a partial back shroud located at rear edges of these vanes. The shroud has cutouts located between adjacent vanes and forming leading shroud edges adapted for cutting the solids. The casing also forms an intake port adjacent to a front side of the impeller and a pump outlet. A back plate of the casing is located adjacent the back shroud and has elongate cutting edges that extend at a substantial angle to the leading shroud edges that are adapted for cutting. These leading shroud edges and the cutting edges on the back plate closely interact to cut solids that have entered into the pump bowl.

Preferably the cutting edges on the back plate are formed by at least one spiral shaped groove formed on an inner surface of the back plate.

In a preferred embodiment of the pump, a disintegrator is mounted on the end of the drive shaft to provide initial cutting of solids as they enter the pump through the intake port.

Further features and advantages will become apparent from the following detailed description of a preferred embodiment, taken into conjunction with the accompanying drawings.

DETAILED DESCRIPTION OF PREFERRED EMBODIMENT

Figure 1:
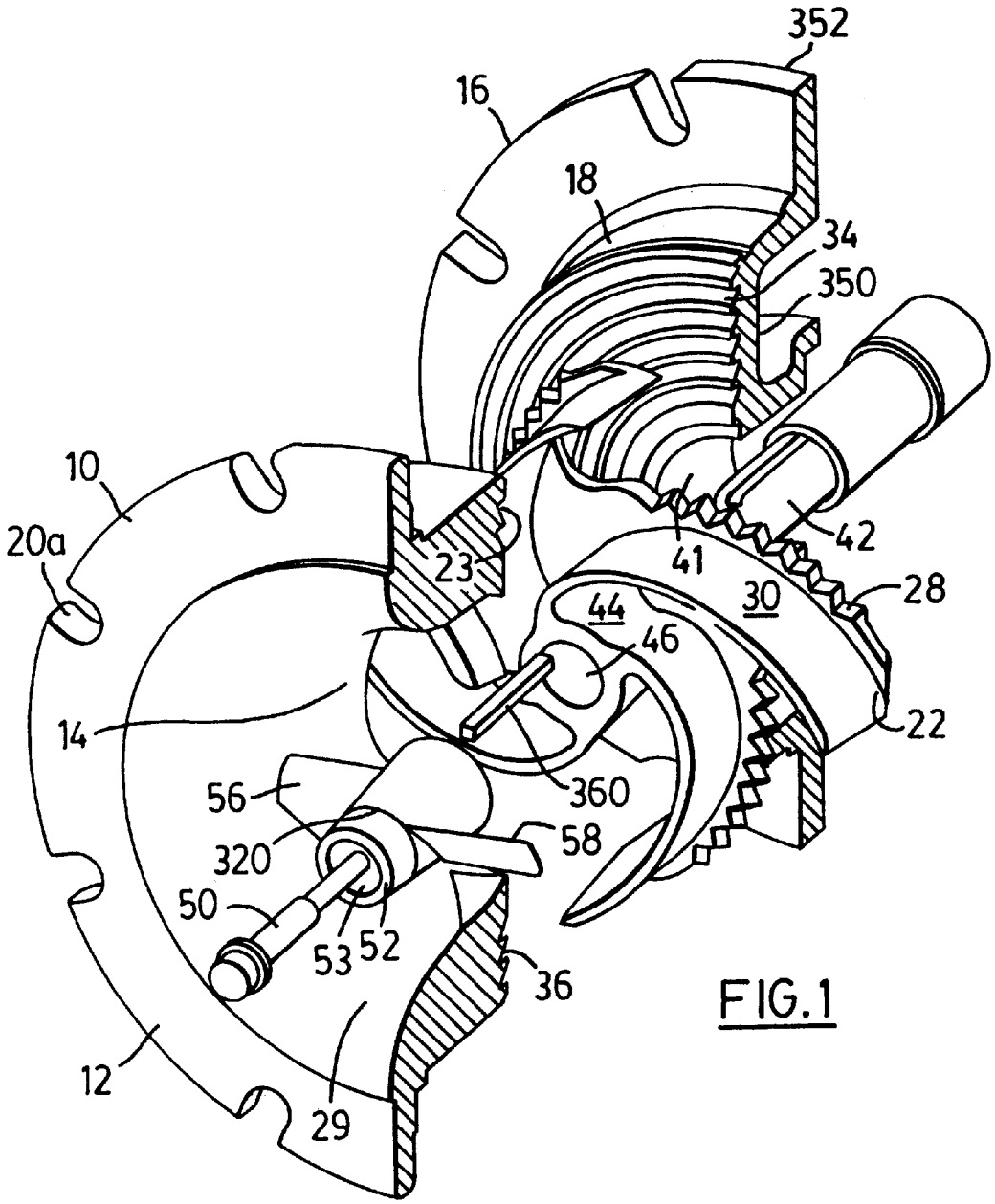
FIG. 1 is an exploded perspective view showing major parts of the centrifugal pump and taken from the intake end, with some parts cutaway for illustration purposes.
Figure 2:
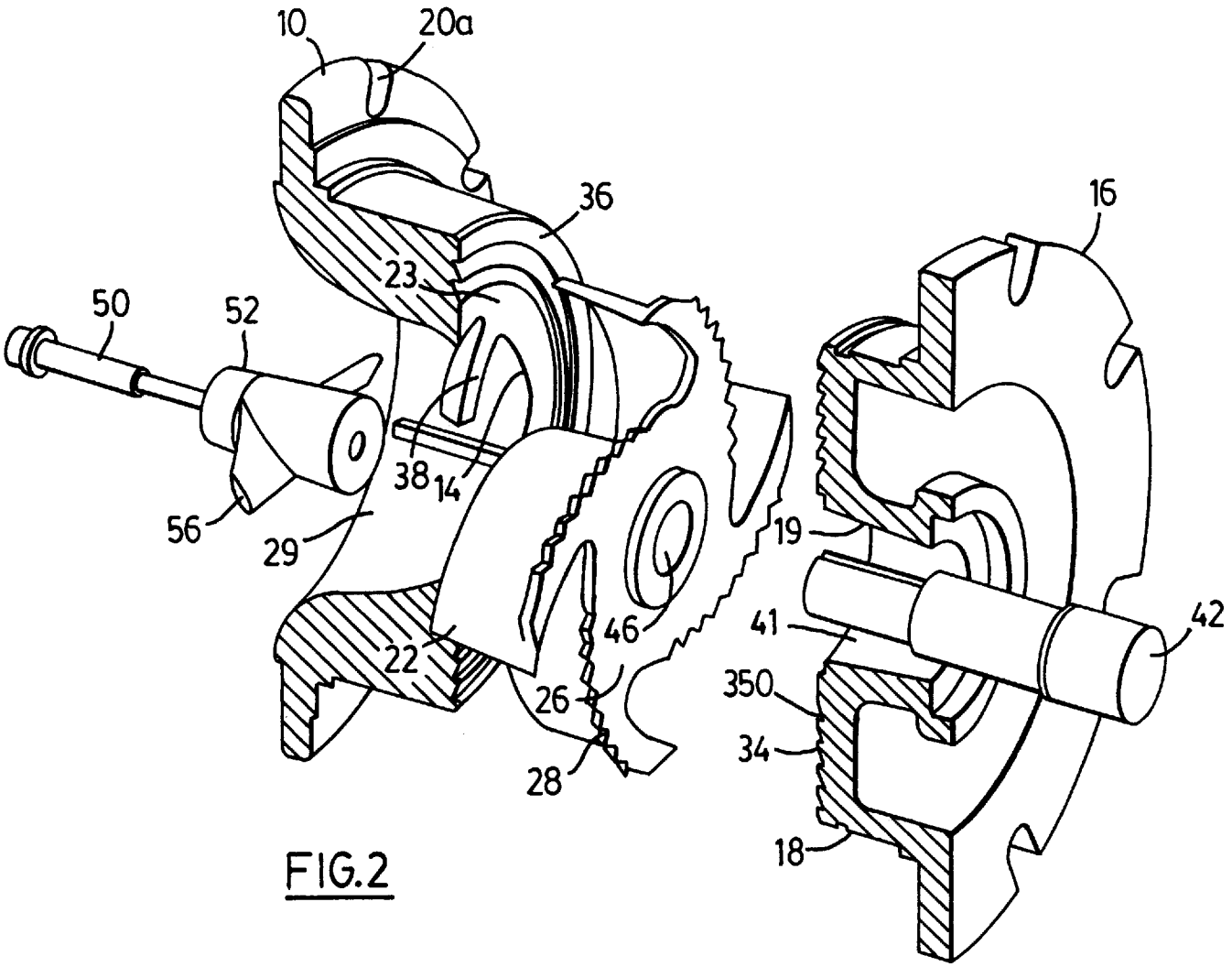
FIG. 2 is another exploded perspective view showing major parts of the centrifugal pump and taken from the side, again with some parts cutaway for sake of illustration.

FIGS. 1 and 2 of the drawings illustrate major parts of a preferred centrifugal pump 12 constructed in accordance with this invention in perspective. Further parts and features of this pump, which is a form of chopper pump, can be seen in FIG. 7. The major components of the pump include a central, rotatable drive shaft 42 that defines an axis of rotation extending along its central longitudinal axis. An impeller 22 is fixedly mounted on this drive shaft and this impeller has a set of radially extending vanes 30 with the illustrated impeller having four such vanes, each of which is curved from its inner end to its outer end. The impeller also has a generally radial, partial back shroud 26 that extends between the vanes and has substantial arc-shaped cutouts forming sharpened, leading shroud edges 28. Preferably these shroud edges are also bevelled and serrated as shown. In the preferred illustrated embodiment, seven or eight teeth having a generally triangular shape provide the serrations between each pair of adjacent vanes. The sharpened edges 28 extend along sides of the cuts. The vanes project generally forwardly from the back shroud towards an intake port 29 of the pump 12. It will be understood that it is the cutouts positioned between the vanes that makes the back shroud 26 a partial shroud.

Figure 7:
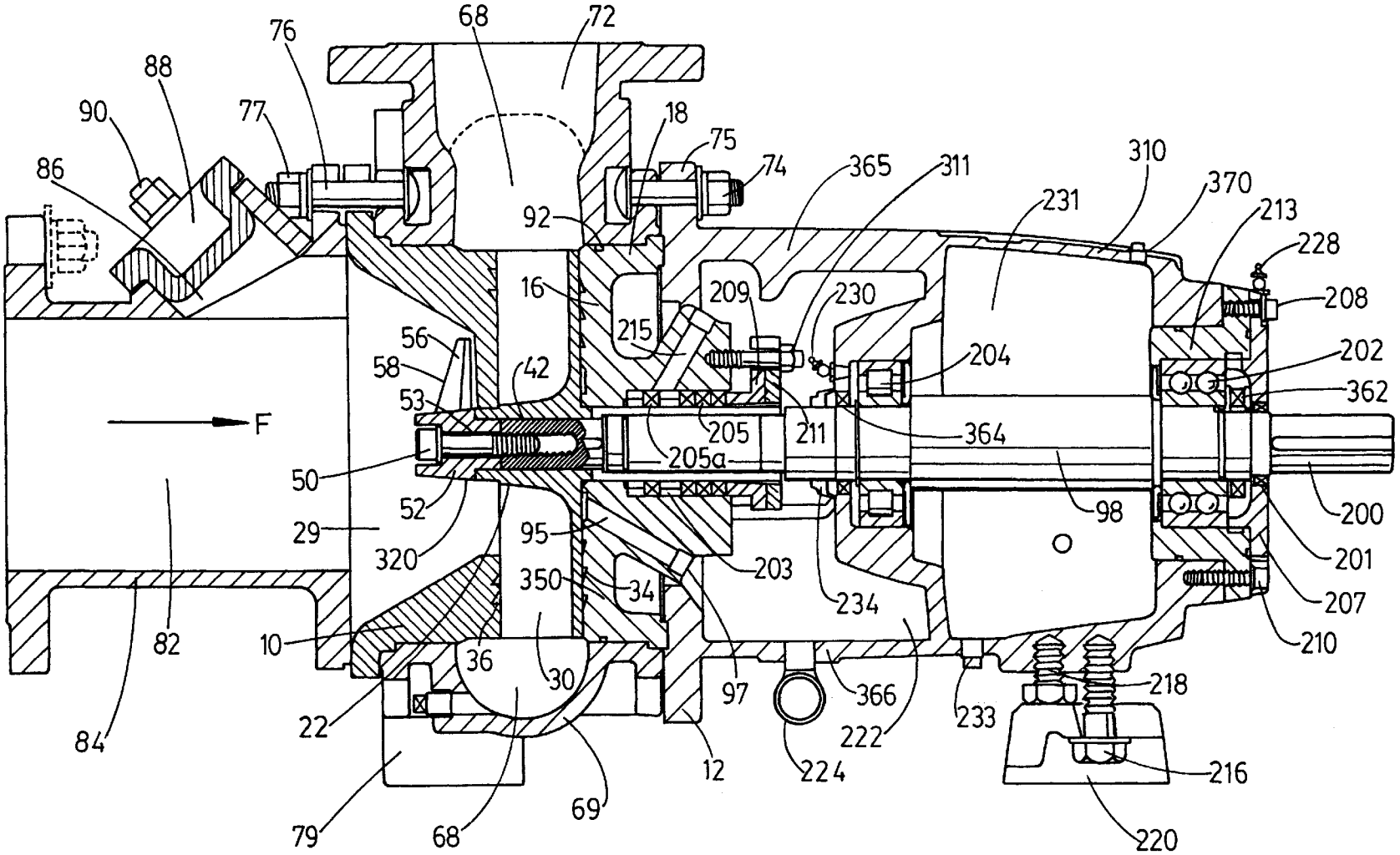
FIG. 7 is a cross-sectional view of a preferred form of centrifugal pump constructed in accordance with the invention.

The pump further includes a pump casing 69 that forms a bowl encircling the impeller in a manner known per se and illustrated in FIG. 7. It is the casing 69 that forms the intake port 29 adjacent to a front side of the impeller 22. Major components of the casing which are illustrated in FIGS. 1 and 2 are an intake plate or cover 10 and a back plate 16, the latter being adjacent to the back shroud 26. The back plate is formed with spiral grooves 34 that face the back shroud. An important feature of the present pump is that the sharpened shroud edges 28 and the spiral grooves 34 interact to cut solids that have entered the pump 12 through the intake port. Preferably the spiral grooves 34 are outward threaded in the direction of rotation of the impeller 22 and extend circumferentially at least several times around the drive shaft 42. As a result of the direction of rotation of the vanes on the impeller and the outward thread of the grooves, any solids in these grooves tend to be expelled or are expelled from the grooves by the shroud edges as they rotate over these grooves.

Figure 3A:
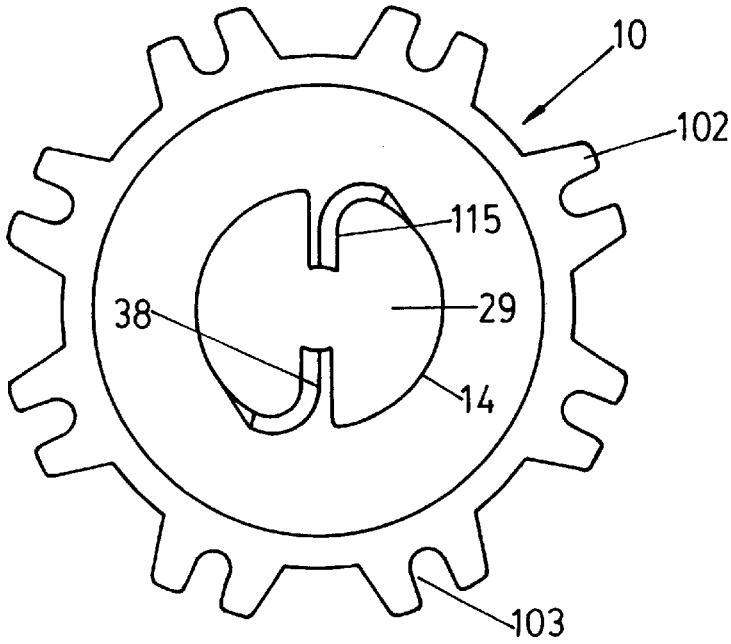
FIG. 3A is a front view of another embodiment for the intake plate for the pump.
Figure 3B:
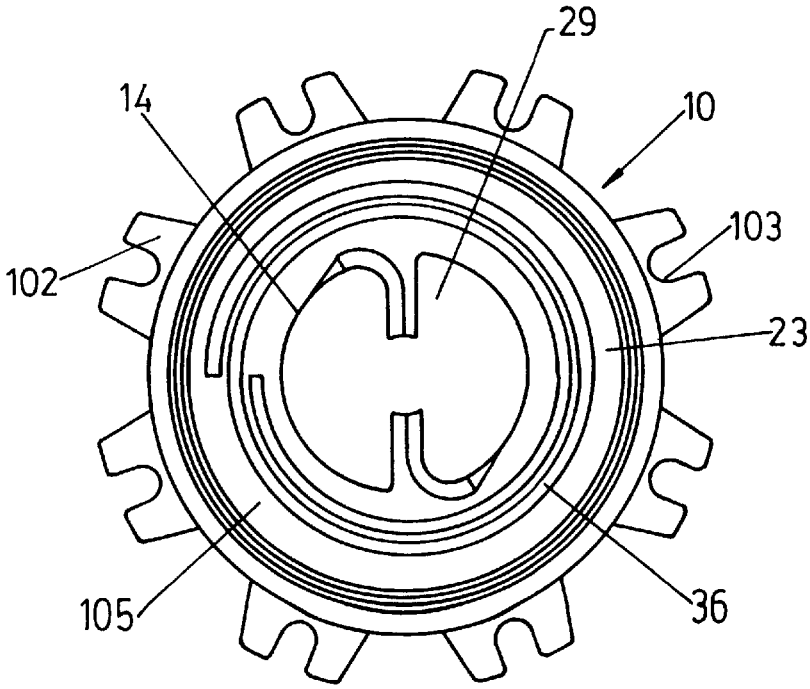
FIG. 3B is a back view of the embodiment of the intake plate illustrated in FIG. 3A.

The preferred form of intake plate 10 is shown in detail in FIGS. 3A and 3B. The inner region of this plate forms an intake cone in order to funnel the incoming liquid into the pump. Extending radially outwardly from the generally circular inner edge 14 is an inner side wall 23 forming one side of the pump bowl. The sidewall 23 thus extends radially outwardly from the input port. The preferred intake plate has eight connecting ears 102 as shown in FIGS. 3A and 3B with each ear having a single bolt receiving notch 103. In the alternate construction shown in FIGS. 1 and 2, the intake plate has a generally circular perimeter with no connecting ears. Eight notches 20*a* are formed in the perimeter of this version. Preferably, spiral shaped grooves 36 are formed on the inner sidewall 23 and extend circumferentially about the intake port 29. The sharpened front edges of the vanes 30 pass closely over these spiral grooves in order to provide additional cutting of solids in the liquid mixture during operation of the pump. In addition, radially inwardly projecting anvil ribs or bars 38 are integrally formed on the intake plate 10 and extend substantially into the intake port. These ribs are also swept closely by the front edges of the vanes 30 during pump operation in order to cut the solids in the liquid mixture that enters through the intake port. The bevelled and sharpened front edge of the anvil ribs is indicated at 115.

Figure 4:
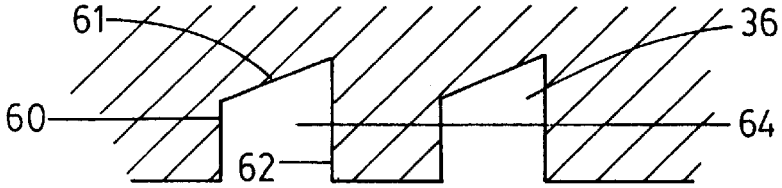
FIG. 4 is a sectional detail view showing the shape of the grooves formed in the back plate.
Figure 5:
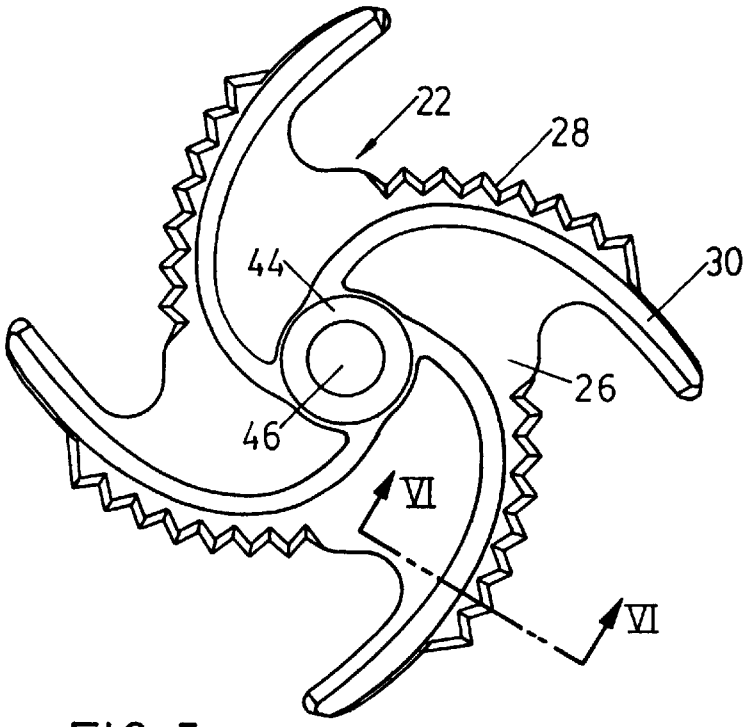
FIG. 5 is a front view of the impeller used in the centrifugal pump.
Figure 6:
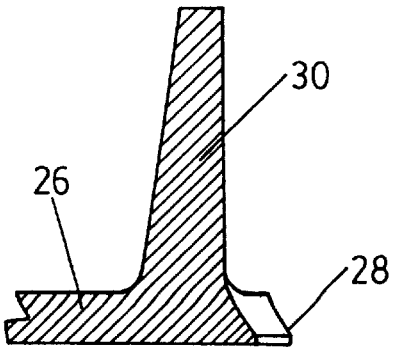
FIG. 6 is a cross-sectional view of one blade of the impeller, this view being taken along the line VI—VI of FIG. 5.

In one embodiment of the pump 12, the intake plate 10 as shown in FIGS. 3A and 3B has an outer diameter of 11 inches and an internal diameter at inner edge 14 of 5.25 inches. The depth of this intake plate is 3.75 inches. The radial cross-section of the spiral grooves 36 is illustrated in detail in FIG. 4. This cross-section is taken along an axial plane extending through the center axis of the drive shaft. The grooves 36 have opposing groove sides 60 and 62 and these are joined at the bottom of the groove by a sloping bottom 61. Thus, the side 62 is deeper than the radially outermost side 60. In one preferred embodiment, the side 60 has a depth of 0.13 inch while the side 62 has a depth of 0.23 inch.

Turning now to the construction of the preferred back plate 16, the cross-section of this plate is shown in detail in FIG. 7 with an alternate possible version being illustrated in FIGS. 1 and 2. The preferred back plate includes a cylindrical outer wall section 18 and a cylindrical inner wall section 19. These two cylindrical wall sections are connected by a radially extending wall section 350. In the back plate of FIGS. 1 and 2, there is a radially outwardly extending connecting flange 352 in which are formed a number of bolt receiving notches 20*b*. In the back plate of FIG. 7, there is no substantial connecting flange 352 but only a short annular outward projection which is received in a suitable annular recess formed about the bowl casing. The aforementioned spiral grooves 34 are formed on the inner surface of the wall section 350 and these grooves can have the same cross-section as the above described grooves 36. The grooves 34 provide cutting edges that extend at a substantial angle to the leading shroud edges 28 that are adapted for cutting. The cutting edges of the back plate extend in a generally circumferential direction around the back plate 16. It will also be noted that the inner wall section 19 forms a round aperture 41 for the drive shaft 42. The shaft extends through this aperture and through a round aperture 46 formed in the hub 44 of the impeller. A key 360 can be used to secure the impeller on the shaft, thereby preventing relative rotation.

Figure 8:
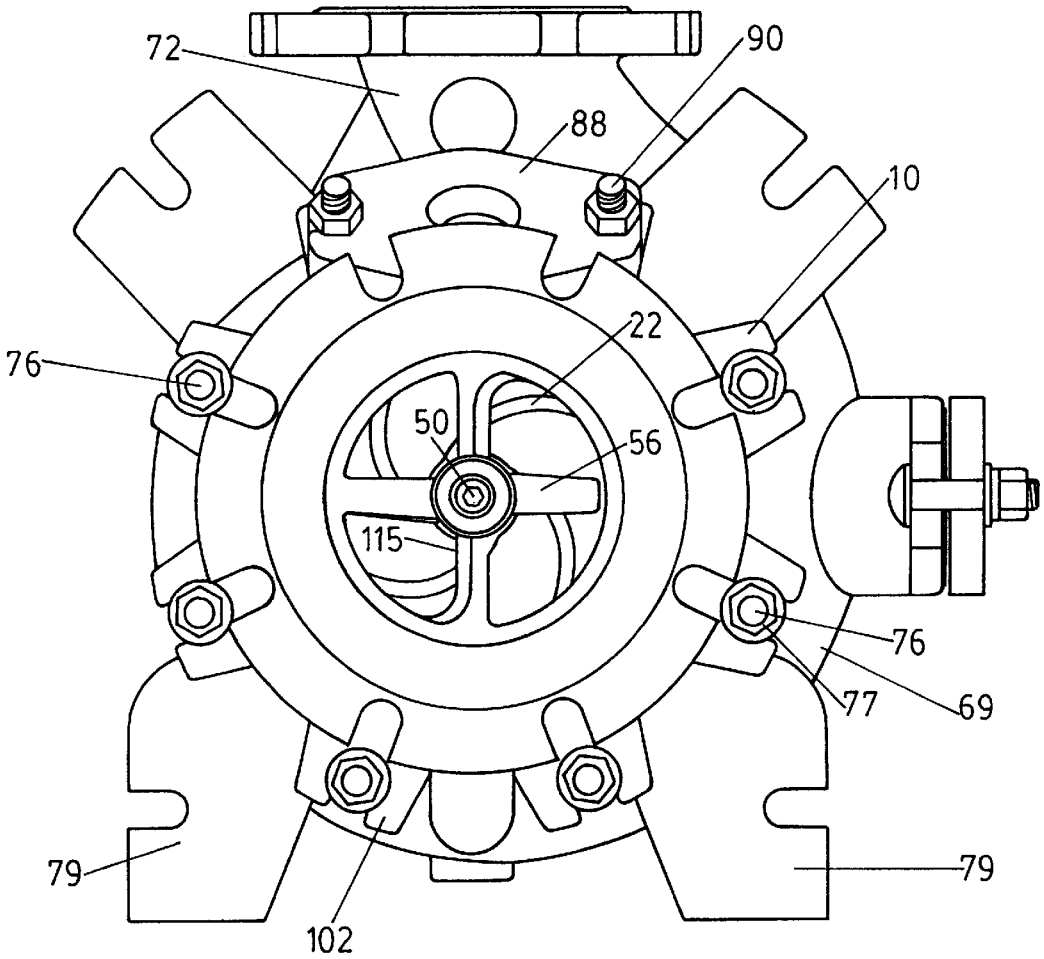
FIG. 8 is a front view of the centrifugal pump shown in FIG. 7.

Referring now to FIGS. 7 and 8 which illustrate a preferred version of the centrifugal chopper pump, an output port 72 is provided for the pump on a top side thereof. It will be noted that a horizontal version of the chopper pump is illustrated but it is also possible for the pump to be constructed as a vertical pump wherein the drive shaft extends vertically. The pump bowl or chamber is indicated at 68 and this bowl is formed about its periphery by the pump casing 69 connected to both the intake plate 10 and the back plate 16. The bowl and its casing extend completely around the circumference of the impeller 22. Bolts 76 and nuts 77 are used to secure the intake plate 10 to the pump casing 69 by means of the aforementioned ears 102. There can also be attached to the front of the intake plate by means of the same bolts and nuts a short intake pipe 84 having a cylindrical intake passageway 82. The intake pipe 84 can be provided with a branch port 86 which is sealed by a removable cover 88 and is provided for suction inspection. The cover 88 can be held in place by two bolts 90 positioned at opposite ends thereof.

It will be understood that after the liquid mixture enters through the intake port 29, the liquid mixture is driven by the impeller 22 around the bowl 68 and out through the output port 72. A suitable discharge pipe can be connected to the port 72 if desired.

Attached to the rear side of the bowl casing is a relatively large oil reservoir and bearing support casing 310 on which is formed a connecting flange or connecting ears 75 at one end of the casing. Connecting bolts 74 and cooperating nuts (one of which is shown in FIG. 7) are used to secure the casing 310 to the bowl casing 69. By connecting the casing in this manner, the preferred back plate 16 is held in place by being clamped in a recess formed about the bowl casing. The liquid mixture which enters the pump in the flow direction indicated by the arrow F will not leak past the back plate because of an O-ring seal 92 that extends about the circumference of the back plate. The main function of the casing 310 is to support a pair of spaced apart bearings 202 and 204 that rotatably support the shaft in the casing. The outer bearings 202 are mounted in a bearing housing or sleeve 213 which is detachably connected to the casing 310 by bolts 210, one of which is shown. At the outer end of the housing 213 is a bearing cap 207 which is attached to the housing 213 by suitable bolts 208. Located on the opposite side of the large cavity 231, which can be filled with lubricating oils is the roller bearing 204. The two bearings 204 and 202 can either be lubricated with the oil in cavity 231 or by means of grease which can be supplied to the bearing 202 by means of grease nipple 228 and which can be supplied to the bearing 204 by means of grease nipple 230. As will be seen in FIG. 7, the shaft section 98 which extends between the two bearings is enlarged and this helps to hold the bearings in place.

A shaft extension 200 extends outside of the casing 310 and this extension can be connected to a pump motor (not shown). Surrounding the base of the shaft extension 200 is a lip seal 201. The rear side of the bearing 202 is held in place by means of a bearing lock nut 362. Located on the pump side of the bearing 204 is a lip seal 364 which is covered by a V-ring 234 that is mounted on the shaft. Also mounted around the shaft and within the back plate structure are packing rings 205 of which there can be several. Located between a forward packing ring 205A and several other packing rings is a lantern ring 203 and located above this ring is a flush connection or passageway 215. When not being used for flushing, the passageway 215 can be closed at its outer end by a suitable plug. The lantern ring, in a known manner, has a number of holes for the purpose of providing water lubrication in the region of the packing ring by water entering through the connection 215. Mounted next to the rear packing rings are a gland follower 209 and a gland plate 211, these being connected to the inner cylindrical wall of the back plate by means of bolts 311, one of which is shown. Also shown in FIG. 7 is an optional impeller flush connection 95 formed in the back plate structure. This passageway is normally closed by means of a plug at 97 when not being used for flushing purposes.

An open space or region 222 surrounds a central section of the shaft 42. Extending across the top of this region is a connecting bar 365 which can act as a handle for the pump. Extending across the bottom of the region 222 is a connecting plate 366 which can be rounded about the bottom side of the shaft to form a dish or trap to catch any liquids in this region. These liquids can drain through a drain 224 connected to the plate 366.

It will be understood that if the cavity 231 is filled with lubricating oil, then grease is not required to lubricate the bearings 204 and 202 and the illustrated grease nipples 228 and 230 are not required. This lubricating oil can be drained from the cavity through a hole in the bottom thereof by removing a drain plug 233. On the opposite side of the cavity 231 is a vent plug 370.

The illustrated horizontal chopper pump can rest on a suitable horizontal surface by means of feet provided at 79 and 220. Two integral feet 79 can be provided at the front end of the pump on opposite sides of the bowl casing 69. The rear portion of the pump can be supported by the foot 220 which is detachably connected to the bottom of the casing 310. An adjusting bolt 218 can be used to adjust the relative height of this foot while a bolt or bolts 216 is used to connect the foot to the casing.

A disintegrator 52 can be optionally mounted on the front end of the drive shaft 42. This disintegrator is formed with a hub 320 having a central aperture 53. The preferred disintegrator has two generally radially projecting, diametrically opposed blades 56. The two blades are illustrated in FIGS. 1 and 2. These blades have edges 58 so that the disintegrator is able to cut solids in the incoming liquid mixture. The disintegrator can be attached to the front end of the shaft by means of a bolt 50 that extends through the aperture 53 and into a threaded hole formed in the front end section of the shaft. The disintegrator is located in the intake port 29, a short distance in front of the impeller.

It will thus be seen that the pump 12 of the invention is constructed so as to prevent the undesirable build up of dirt and contaminents in the space between the back shroud of the impeller and the back plate. In the past, dirt and contaminents have built up behind the back shroud of the pump causing damage and degradation to the shaft seals and the packing. This problem is reduced or eliminated with the described pump of this invention due to the cutting of solids in this region by the interaction between the spiral grooves 34 and the sharpened edges formed on the partial back shroud. Preferably the leading shroud edges are bevelled and serrated for at least a substantial portion of their respective lengths resulting in a very good cutting action as these leading edges sweep over the spiral grooves.

Various modifications and changes to the preferred centrifugal pump described herein will be apparent to those skilled in the art of making centrifugal pumps. Accordingly, all such modifications and changes as fall within the scope of the appended claims are intended to be part of this invention.

We claim:

1. A centrifugal pump capable of cutting solid matter in a liquid comprising:

a rotatable drive shaft defining an axis of rotation;

an impeller mounted on said drive shaft, the impeller having a set of radially extending vanes and a generally radial, partial back shroud that extends between said vanes and has substantial cut-outs positioned between said vanes to make said back shroud a partial shroud, sharpened leading shroud edges being provided along sides of said cut-outs, said vanes projecting generally forwardly from said shroud and towards an intake port of the pump; and a pump casing including a bowl encircling said impeller, said casing forming said intake port adjacent to a front side of said impeller and including a backplate adjacent to the back shroud, said backplate having spiral grooves facing said back shroud;

wherein said sharpened shroud edges and said spiral grooves interact for the means to cut solids that have entered said pump through said intake port.

2. The centrifugal pump of claim 1 wherein said vanes are curved and said leading shroud edges are beveled and serrated.

3. The centrifugal pump of claim 2 wherein said spiral grooves are outward threaded and extend circumferentially at least several times around said drive shaft and solids in said grooves are expelled therefrom by said leading shroud edges as they rotate over said grooves.

4. The pump of claim 3 wherein the cut-outs are arc-shaped.

5. The centrifugal pump of claim 4 further including a disintegrator comprising a hub and generally radially projecting, diametrically opposed blades connected to said hub, said disintegrator being mounted on an end of said drive shaft and located in said intake port.

6. The centrifugal pump according to claim 4 wherein said casing includes an intake cover with an inner radial surface facing said impeller, said intake cover has further spiral grooves formed in said inside radial surface, and sharpened front edges of said vanes lie closely adjacent said further spiral grooves and co-operate with these grooves to provide additional solids cutting action.

7. A centrifugal pump suitable for pumping a liquid mixture containing solids, said pump comprising:

a rotatable drive shaft defining an axis of rotation;

an impeller mounted on said drive shaft for rotation therewith, said impeller having radially extending vanes and a generally radial, partial back shroud located at rear edges of said vanes, said shroud extending between said vanes and having substantial cut-outs located between adjacent vanes to make said shroud a partial shroud, leading shroud edges being formed along sides of said cut-outs and being sharpened; and pump casing means for forming a pump bowl that surrounds said impeller, an intake port adjacent to a front side of said impeller, and a pump outlet, said pump casing means including a backplate located next to said back shroud and having spiral shaped grooves extending circumferentially thereon and facing said back shroud, said shaft extending through said back plate, wherein said sharpened shroud edges and said grooves interact are for the means to cut solids that have entered into said pump bowl.

8. The centrifugal pump of claim 7 wherein said vanes are curved and said leading shroud edges are beveled and serrated for at least a substantial portion of their respective lengths.

9. The centrifugal pump according to claim 8 wherein said pump casing means includes an intake plate that forms said intake port, said intake plate has an inner side wall forming one side of said pump bowl, said inner side wall having an outer radius and an inner radius, at least a portion of the inner side wall between said inner radius and said outer radius has spiral grooves, and said inner radius is the circumference of said intake port at its innermost end.

10. The centrifugal pump according to claim 9 wherein said intake plate has cutting bars that project radially inwardly into said intake port and that are located directly and radially inwardly of said inner side wall.

11. The centrifugal pump according to claim 10 wherein front edges of said vanes interact with the spiral grooves on said inner side wall and said cutting bars to cut and chop solids in said mixture.

12. The centrifugal pump of claim 11 wherein said cutting bars are sharpened and beveled along one side thereof.

13. The centrifugal pump according to claim 7 wherein said spiral shaped grooves on said back plate are outward threaded and there are a number of these grooves each of which extends entirely about the circumference of the back plate, which is circular.

14. The centrifugal pump according to claim 13 further comprising:

a disintegrator comprising a hub and generally radially projecting blades connected to said hub, said disintegrator being mounted on an end of said drive shaft.

15. A centrifugal pump suitable for pumping a liquid mixture containing solids, said pump comprising:

a rotatable drive shaft defining an axis of rotation;

an impeller mounted on said drive shaft for rotation therewith, said impeller having at least several radially extending vanes and a partial back shroud located at rear edges of said vanes, said shroud having cut-outs located between adjacent vanes and forming leading shroud edges adapted for cutting said solids; and pump casing means for forming a pump bowl, that surrounds said impeller, an intake port adjacent to a front side of said impeller, and a pump outlet, said pump casing means including a back plate located adjacent said back shroud and having cutting edges that extend at a substantial angle to said leading shroud edges that are adapted for cutting, said drive shaft extending through said back plate, and an intake plate forming said intake port and an inner wall that faces front edges of said vanes, said inner wall having additional spiral grooves with top edges that are swept by said front edges of said vanes when said impeller is rotated, wherein said leading shroud edges and said cutting edges on the back plate closely interact to cut solids that have entered into said pump bowl.

16. A centrifugal pump according to claim 15 wherein said leading shroud edges are serrated and sharpened and said cutting edges on said back plate extend in a generally circumferential direction around said back plate.

17. A centrifugal pump according to claim 16 wherein cutting edges on said back plate are formed by at least one spiral shaped groove formed on an inner surface of said back plate.

18. A centrifugal pump according to claim 15 including cutting bars integrally formed on said intake plate and projecting radially inwardly into said intake port, wherein said front edges of the vanes and said cutting bars closely interact to cut and chop solids entering said pump bowl.

19. A centrifugal pump according to claim 16 including bearing means and supporting structure therefor for rotatably supporting said drive shaft and means for sealing and lubricating said bearing means.

* * * * *

UNITED STATES PATENT AND TRADEMARK OFFICE

CERTIFICATE OF CORRECTION

PATENT NO. : 6,190,121 B1
DATED : February 20, 2001
INVENTOR(S) : John Hayward et, al.

It is certified that error appears in the above-identified patent and that said Letters Patent is hereby corrected as shown below:

Column 7, claim 7,
Line 57, delete "are for the means"

Signed and Sealed this

Sixth Day of November, 2001

*Attest:*

Nicholas P. Godici

NICHOLAS P. GODICI
*Acting Director of the United States Patent and Trademark Office*

*Attesting Officer*